United States Patent [19]

Knopf et al.

[11] Patent Number: 4,733,787

[45] Date of Patent: Mar. 29, 1988

[54] TAMPER EVIDENT OVERCAP

[75] Inventors: Norman D. Knopf, West Windsor; Heinz P. Meyer, Somerville, both of N.J.; Abraham Leibson, Buckingham, Pa.

[73] Assignee: Merck & Co., Inc., Rahway, N.J.

[21] Appl. No.: 869,480

[22] Filed: Jun. 2, 1986

[51] Int. Cl.[4] ..... B65D 47/10

[52] U.S. Cl. ..... 215/251; 215/254; 220/257; 220/270

[58] Field of Search ..... 220/214, 257, 270; 215/249, 251, 253, 254

[56] References Cited

U.S. PATENT DOCUMENTS

| | | | |
|---|---|---|---|
| 3,067,898 | 12/1962 | Reimann | 215/249 |
| 3,286,875 | 11/1966 | Frankenberg | 220/270 |
| 3,515,307 | 1/1969 | Gach | 220/214 |
| 4,029,231 | 6/1977 | Jonsson | 220/270 |
| 4,320,861 | 3/1982 | Rieke et al. | 215/249 |

FOREIGN PATENT DOCUMENTS

| | | | |
|---|---|---|---|
| 712102 | 7/1954 | United Kingdom | 215/249 |

*Primary Examiner*—Stephen Marcus
*Assistant Examiner*—Nova Stucker
*Attorney, Agent, or Firm*—David L. Rose; Michael C. Sudol, Jr.

[57] ABSTRACT

There is disclosed an overcap for a container with a primary cap for the removal of the contents thereof, whereby the overcap is easily assembled onto the container and completely surrounds the primary cap. When assembled, the overcap prevents access to the primary cap, and when removed, the overcap becomes irreversibly deformed such that visual evidence is clearly apparent that access to the primary cap has been gained. The irreversible deformity consists of tabs connecting the pull-tab to the overcap, and weakened areas in the side of the overcap which must be torn to allow removal of the primary cap.

8 Claims, 7 Drawing Figures

TAMPER EVIDENT OVERCAP

BACKGROUND OF THE INVENTION

It is of increasing concern that packaged contents be maintained free of either accidentally or intentionally being contaminated by extraneous material that may either reduce the effectiveness of the packaged material or present a hazardous condition to the consumer of the packaged material. A packaging design that will absolutely prevent tampering is not generally feasible, and most efforts have been aimed at packaging which will not prevent access to the container, but will give clear and irreversible evidence that the package has been previously opened or tampered with. Current designs have concentrated on the closure or cap of the container providing for a cap which will separate into two or more parts upon opening. The instant invention provides for a standard primary cap and an overcap which cannot be removed without substantial irreversible distortion thereof which will give clear evidence of tampering.

SUMMARY OF THE INVENTION

The instant invention is concerned with a tamper evident overcap which cannot be removed without the substantial deformity and destruction thereof which renders its reinstallation on the container impossible. Thus it is an object of this invention to describe such a tamper evident overcap. It is a further object to describe the structure and operation of such overcap. Further objects will become obvious from a consideration of the following description.

DESCRIPTION OF THE INVENTION

The instant tamper evident overcap consists of a top of generally flat construction with an integrated handle or lifting device. The top is attached to a double walled sidewall assembly. The lifting device is attached securely to the sidewall assembly and attached at one or more points to the top with easily breakable attachment means which preferably are thin sections of the same material of which the overcap is made. The double walled sidewall assembly consists of an inner wall and an outer wall. The secure attachment of the lifting device is attached to the outer wall or to the common contact point of the outer and inner walls. The secure connection of the lifting device is provided with one or more weakened areas adjacent thereto, preferably one of which runs the length of the outer wall from the top to the bottom edge thereof and additional weakened areas which only partially run the length of the outer wall. This arrangement allows for the lifting device to remain attached to the outer wall to facilitate the complete removal of the overcap from the container. The weakened areas can be made by thinning the outer wall in the area adjacent to the lifting device or by perforating the weakened areas. The inner wall is provided with a locking device which will permit the facile but irreversible installation of the overcap on the container. One method provides for a wedge-shaped protrusion or notch on the inner surface of the overcap which irreversibly engages with a matching notch or protrusion respectively on the container. The most secure arrangement is generally found with an inner wall which is circumferential about the cap and an outer wall circumferential about the inner wall. The lower surface of the outer wall should be very close to or preferably touching the container at all points in order to prevent the insertion of a pointed device between the lower edge of the outer wall and the container to gain access to and defeat the anchoring device on the inner wall. The lower edge of the outer wall may further be recessed into a matching groove in the container for added security.

In the operation of the tamper evident overcap, the secure mounting of the inner wall on the container and the circumferential arrangement of the inner and outer walls about the primary cap of the container, prevents access of the primary cap. The lifting device initially breaks the breakable attachments between it and the top and further lifting of the lifting device, followed by outward and downward motions tears the outer cap along the weakened areas. Thus, tampering with the overcap becomes evident from the breakable attachments being broken and the sidewall being torn along the weakened areas. The tampering is irreversible since the breakable attachments and the weakened areas are completely broken through and cannot be reconnected.

The instant application is accompanied by the drawings as FIGS. 1 through 6 which illustrate one or more preferred embodiments of this invention.

Figure 1:
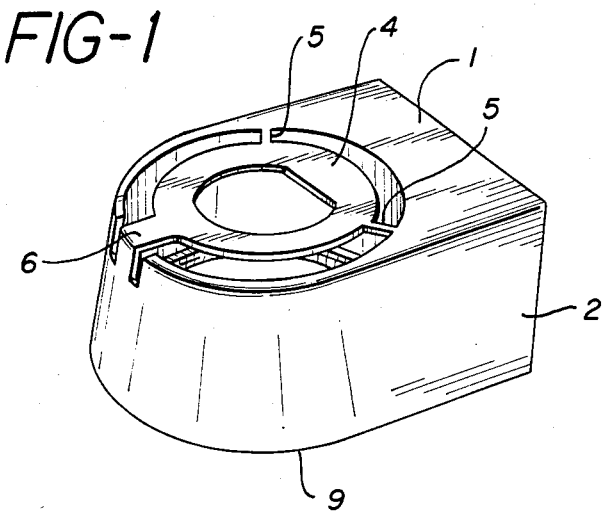
FIG. 1 is a drawing in perspective of one version of the tamper evident overcap.
Figure 2:
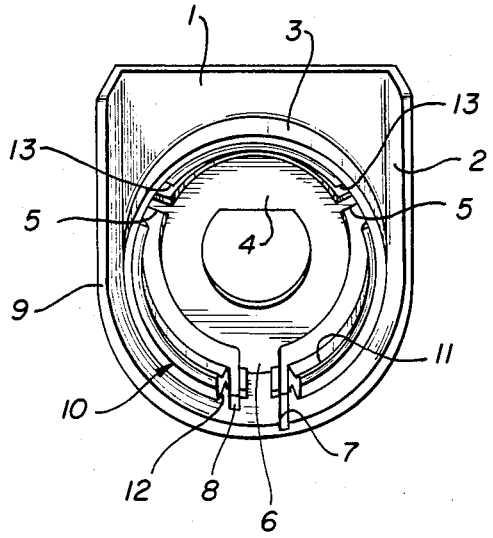
FIG. 2 is a drawing in perspective of the tamper evident overcap as viewed from the bottom showing the construction of the inner wall.
Figure 6:
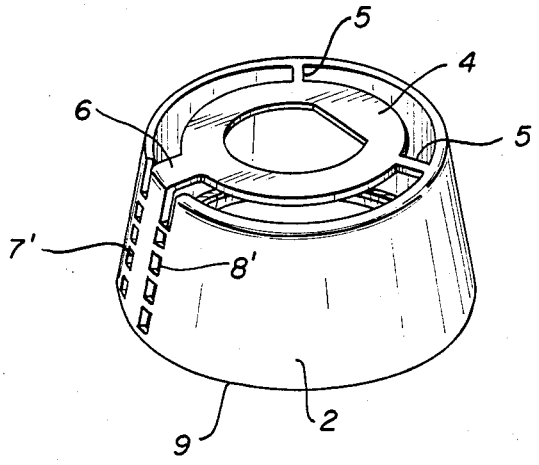
FIG. 6 is a drawing in perspective of another version of the tamper evident overcap.

Referring now to FIGS. 1 and 2, one version of the instant tamper evident overcap consists of a top 1, of generally flat construction attached at the outer edge thereof to the top edges of an outer wall 2 and an inner wall 3. Integrated with the surface of top 1 is a lifting device 4 attached to the top 1 by one or more breakable attachments 5 and also attached to the outer wall 2 by a secure attachment 6. Adjacent to the secure attachments are weakened areas which may extend the complete top to bottom distance along the outer wall as in 7, or such weakened areas may extend partially from the top of the outer wall as in 8. Alternatively as shown in FIG. 6, the weakened areas 7 and 8 may be perforations through the outer wall 2 where perforation 7' extends to the lower edge of the outer wall and perforation 8' extends only partly to the lower edge.

The outer wall 2 extends from the top 1 to a lower edge thereof 9, which is very close to or in contact with the container in order to prevent the insertion of a foreign object under the outer wall 2 to gain access to the inner wall 3. Alternatively the lower edge 9 of the outer wall 2 may fit into a recess or groove on the container 15 to further ensure the integrity of the device. The outer wall may be circular in cross section as shown in FIG. 6, or it may be designed to conform to the shape of the container as shown in FIGS. 1 to 5 and 7 where the shape of the overcap blends in smoothly with the shape of the container, specifically the handle of the container.

Figure 3:
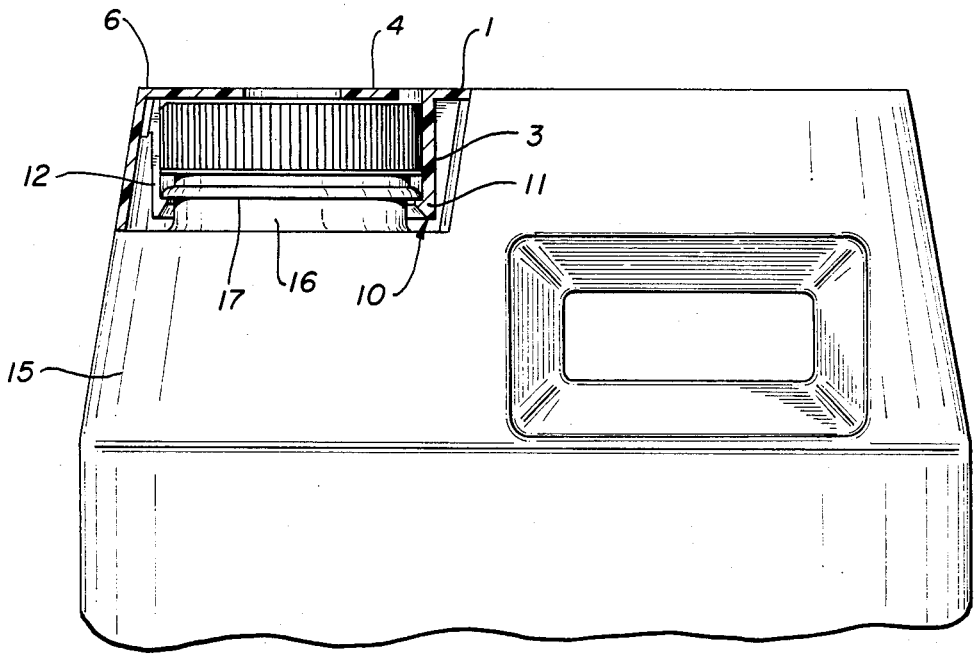
FIG. 3 is a drawing in partial cross section of the overcap installed on a container.
Figure 7:
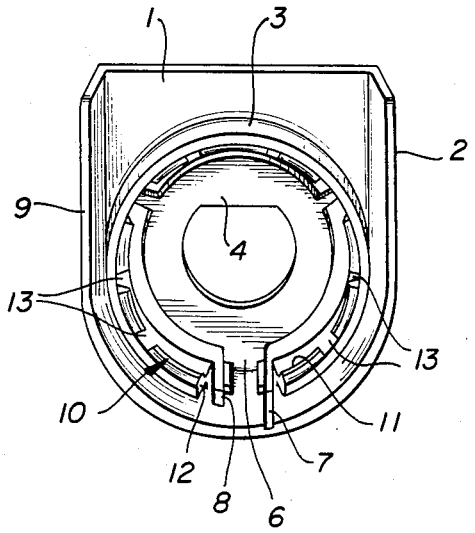
FIG. 7 is a drawing in perspective of the tamper evident overcap as viewed from the bottom showing another version of the locking means.

The inner wall 3, also attached to the outer edge of top 1, is generally circular in cross section and is provided with locking means 10 which mate with similar locking means on the container such that when the overcap is installed on the container, it cannot be removed. One example of such locking means is a wedge-shaped protrusion on the lower edge of the inner wall with the wide portion of the wedge 11, facing towards the top 1, which matches a notch or groove 16 on the container oriented such that the wide portion of the wedge 11 recesses into the groove 16 and is thus prevented from being removed since any upward force on the overcap merely presses the wide portion of the wedge 11 against the upper portion 17 of the groove 16. The upper portion of groove 16 may also be formed as a flange 17. The inner wall 3 may also be provided with one or more gaps 12, and the locking means 10 may be provided with one or more gaps 13 to facilitate the installation of the overcap as well as to allow the easy removal of the overcap when the outer wall 2 is torn. The gap in the inner wall 3 will allow the inner wall to expand, freeing the locking means 10 from the container. The gap 12 extends from the lower edge of the inner wall 3 through the locking means and at least part of the way towards the top to relieve some of the strain attributed to the "hoop strength" of the inner wall, as the wedge 11 is forced into its matching notch or over the protrusion. The gap 13 usually extends only through the locking means. Alternatively, the locking device need not be the relatively continuous wedge 11 as shown in FIG. 3, but may be a series of discrete protrusions or teeth to provide for the engagement with groove of the container as shown in FIG. 7.

Figure 4:
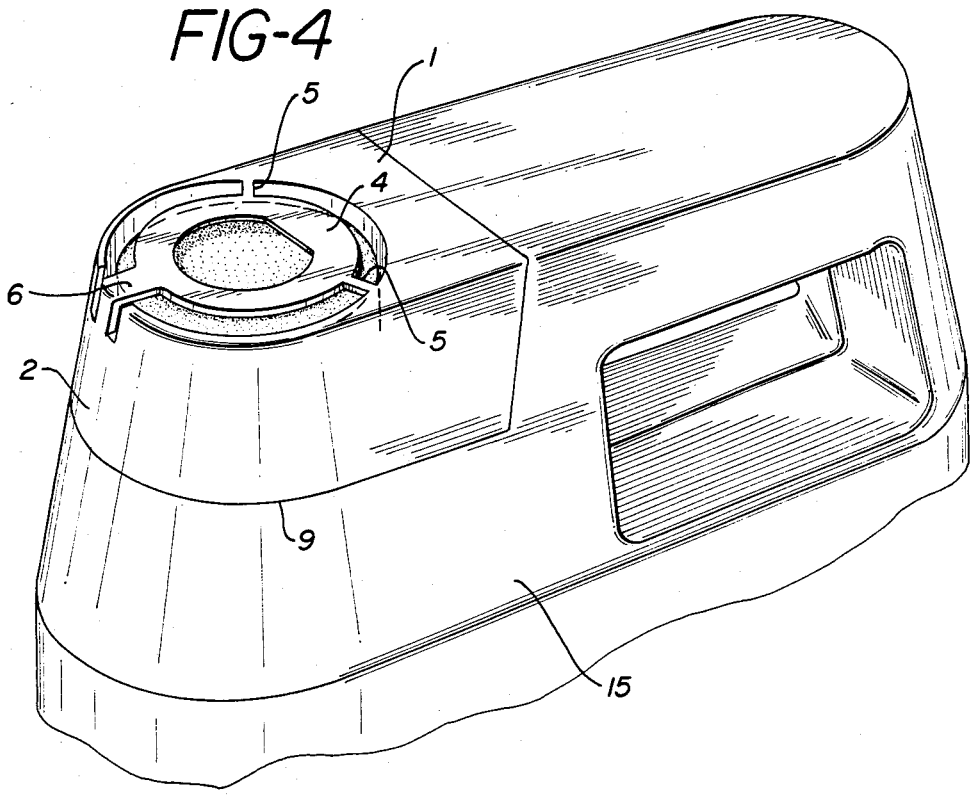
FIG. 4 is a drawing in perspective of the tamper evident overcap as installed on a container.
Figure 5:
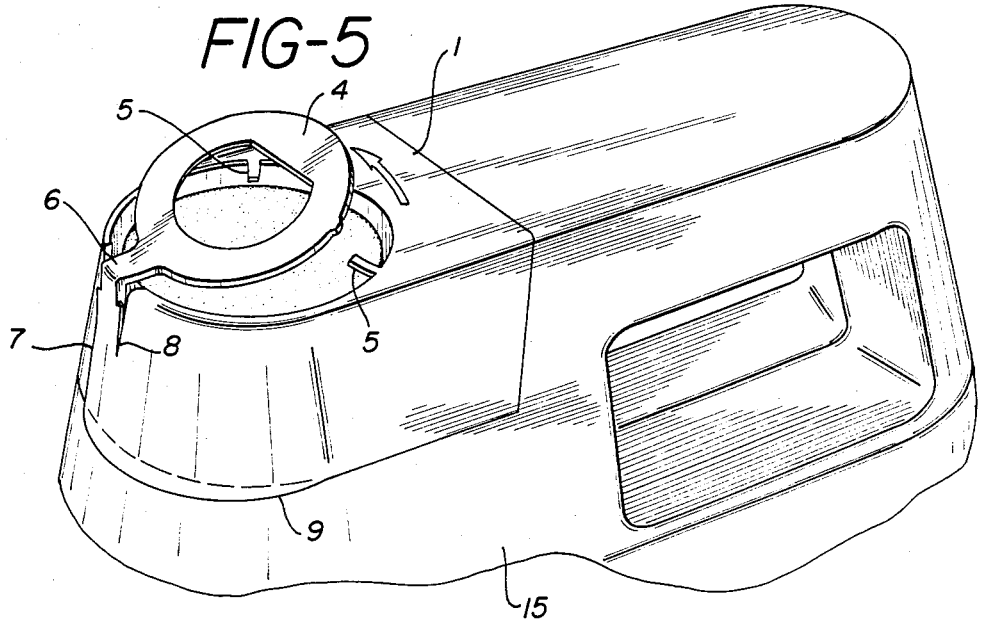
FIG. 5 is a drawing in perspective of the tamper evident overcap as installed on a container and in the process of being removed from the container.

The operation of the tamper evident overcap of this invention is shown in FIGS. 4 and 5. The lifting device 4 is initially raised which immediately causes the rupture of the breakable attachment 5. Further lifting of the lifting device 4 followed by an outward then a downward application of force on the lifting device in essentially Pivoting about the secure attachment 6 results in the tearing of the weakened areas 7 and 8. Only weakened area 7 is torn completely through which maintains the attachment of the lifting device 4 to the outer wall 2 facilitating the final removal of the overcap from the container by allowing the person removing the overcap to continuously apply force without having to change their grip on the lifting device. When the full weakened area 7 has been torn completely through, the locking means 10 are released and the overcap can then be completely removed from the container allowing access to the primary cap. Since the overcap can only be removed by rupture of the breakable attachments 5 and the tearing of the weakened areas 7 and 8, once the overcap is removed and access to the primary cap is gained it will become immediately apparent, and it will not be possible to reinstall the overcap.

The overcap will completely surround the primary cap and the clearance between the top 1 and inner wall 3 of the overcap should only be such as to avoid any interference between the two and to prevent removal of the primary cap while it is still within the overcap.

The tamper evident overcap can be made of any material, however, a moldable plastic, generally referred to as engineering plastics, such as polyolefins in particular polyethylene, polypropylene, polystyrene, and the like are usable. Preferably high-density polyethylene is used.

The instant overcap provides the further advantage in being made on one piece construction which greatly facilitates its attachment to the container. The overcap is merely placed over the primary cap and pushed with sufficient force so as to engage the locking means 10 on the container. The facile installation of the overcap on the container also readily allows for a mechanized assembly of the overcap on the container. Further, the instant overcap will allow the use of any standard primary cap since there is no connection or engagement of the primary cap with the overcap.

What is claimed is:

1. On a container with a primary cap, a tamper evident overcap fitting over and surrounding the primary cap, with a top connected at its outer edge to the top edges of an inner wall and an outer wall, said top edges of said inner and outer walls are covergent over a substantial portion of the outer edge of said top, said top including an integrated handle connected to the top by easily breakable attachment means and to the outer wall by secure attachment means; said outer wall extending from the top to the surface of the container and provided with one or more weakened areas adjacent to the secure attachment means extending at least part of the distance from said secure attachment means to the lower edge of the outer wall and wherein at least one of the weakened areas of the outer wall extends from the secure attachment to the lower edge of the outer wall; and said inner wall is provided with locking means for engagement with the container.

2. The tamper evident overcap of claim 1 wherein the easily breakable means are one or more relatively thin sections of the same material of which the overcap is made.

3. The tamper evident overcap of claim 1 wherein the locking device consists of a wedge-shaped protrusion on the lower edge of the inner wall with the wider portion of the wedge-shaped protrusion being closest to the top, and wherein said wedge-shaped protrusion engages with a matching notch or protrusion on the container.

4. The tamper evident overcap of claim 1 wherein the locking device is a series of discrete protrusions along the lower edge of the inner wall for engagement with the container.

5. The tamper evident overcap of claim 1 wherein said inner wall is provided with one or more gaps extending through the locking means from the lower edge of the inner wall at least part of the way towards the top.

6. The tamper evident overcap of claim 1 which is made of one-piece construction.

7. The tamper evident overcap of claim 1 wherein the weakened areas are formed by providing for sections of the outer wall to be thinner than the remainder of the outer wall.

8. The tamper evident overcap of claim 1 wherein the weakened areas are formed by perforating the outer wall.

* * * * *